United States Patent [19]

Koerner et al.

[11] Patent Number: 4,495,851

[45] Date of Patent: Jan. 29, 1985

[54] APPARATUS FOR SETTING AND/OR MONITORING THE OPERATION OF A SHELL FUSE OR DETONATOR

[75] Inventors: Hans-Gerhard Koerner, Schriesheim; Helmut Lang, Sandhausen; Rainer Berthold, Gaiberg; Rainer Strietzel, Heidelberg; Friedrich Melchior, Laudenbach, all of Fed. Rep. of Germany

[73] Assignee: Brown, Boveri & Cie AG, Mannheim, Fed. Rep. of Germany

[21] Appl. No.: 450,759

[22] Filed: Dec. 17, 1982

[30] Foreign Application Priority Data

Dec. 18, 1981 [DE] Fed. Rep. of Germany ..... 3150172

[51] Int. Cl.[3] ..... F42C 17/00

[52] U.S. Cl. ..... 89/6.5; 102/270

[58] Field of Search ..... 89/6, 6.5; 102/270, 102/214

[56] References Cited

U.S. PATENT DOCUMENTS

| | | | |
|---|---|---|---|
| 3,714,898 | 2/1973 | Ziemba | 89/6 |
| 4,022,102 | 5/1977 | Ettel | 89/6.5 |
| 4,091,734 | 5/1978 | Redmond et al. | 89/6.5 |
| 4,142,442 | 3/1979 | Tuten | 89/6.5 |
| 4,144,815 | 3/1979 | Cumming et al. | 102/214 |
| 4,214,534 | 7/1980 | Richter et al. | 89/6.5 |
| 4,237,789 | 12/1980 | Stauers et al. | 102/270 |

FOREIGN PATENT DOCUMENTS

| | | |
|---|---|---|
| 2508201 | 9/1976 | Fed. Rep. of Germany . |
| 2919753 | 5/1979 | Fed. Rep. of Germany . |
| 2920853 | 12/1979 | Fed. Rep. of Germany . |
| 2944115 | 5/1980 | Fed. Rep. of Germany . |

*Primary Examiner*—Charles T. Jordan

*Attorney, Agent, or Firm*—Herbert L. Lerner; Laurence A. Greenberg

[57] ABSTRACT

Apparatus for setting and/or monitoring the operation of an electronic fuse for shells to be fired from a gun, by transmitting a microwave data signal and a microwave energy signal to a device inside the fuse from a device outside the fuse, the device inside the fuse including an energy receiver with a rectifier for generating a supply voltage, a data receiver, a data processing unit and a fuse electronic system, and the device outside the fuse including an energy transmitter, an input/output unit and a data transmitter, including means for disposing the device outside the fuse so that the transmission of the microwave signals occurs at the latest during loading of the shell carrying the fuse into the gun; means for transmitting the energy signal and the data signal together and simultaneously; a reply signal transmitter additionally included in the device inside the fuse; a reply signal receiver additionally included in the device outside the fuse; the data-signal transmitting means and the reply signal transmitter being actuable for transmitting and exchanging information in opposite directions; and a respective single antenna located at the fuse and at the device outside the fuse for receiving and transmitting energy, data and reply signals.

9 Claims, 5 Drawing Figures

APPARATUS FOR SETTING AND/OR MONITORING THE OPERATION OF A SHELL FUSE OR DETONATOR

The invention relates to apparatus for setting and/or monitoring the operation of an electronic fuse or detonator for shells by transmitting a microwave data signal and a microwave energy signal from a device outside the fuse to a device inside the fuse, the device inside the fuse including an energy receiver with a rectifier for generating a supply voltage, a data receiver, a data processing unit and a fuse electronic system, and the device outside the fuse including an energy transmitter, and input/output unit and a data transmitter.

Apparatus of such general type is known from U.S. Pat. No. 4,144,815. The setting values computed by a fire control computer for the shell fuse are modulated on a microwave signal and are radiated by an antenna which is mounted in a bore hole in a gun barrel. The gun barrel itself serves as a microwave guide. A receiving antenna at the fuse receives the incident microwave signal and feeds it via a double-throw switch either to a rectifier device which generates therefrom a d-c supply voltage, or to a filter which acts as a demodulator and filters the data from the arriving signal.

For setting the fuse, an energy signal of high power is transmitted first, so that a sufficiently high d-c voltage is available for supplying the data electronic system and the fuse electronic system during the subsequent data transmission and fuse programming. The data are transmitted via a low-power amplitude-modulated microwave signal.

A disadvantage of the heretofore known construction is that a bore or drill hole must be formed in the gun barrel for inserting the microwave antenna; in the gun barrel, pressures of more than 3000 bar and temperatures of between 2000° and 3000° C. occur, and the barrel temperature itself may be between 60° and 600° C. A further disadvantage is that the time for the data transmission is limited by the storage capacity of the rectifier circuit. This storage capacity also limits the time between the data transmission and the launching of the shell. Otherwise, the memories of the fuse electronic system would lose the stored data. For this reason, data transmission is possible only immediately prior to the firing and also only once.

It is thus not possible to monitor the correct transmission of the fuse-setting data; it is likewise impossible to check the fuse electronic system for freedom from errors.

Similar apparatus is also known from German Published Prosecuted Application (DE-AS) No. 29 44 115. This relates to a magnetic induction device with at least two independent magnetic control circuits, one of which serves for transmitting an energy signal, and the other for transmitting a data signal. This heretofore known apparatus permits transmission to the fuse of the necessary energy and the different information signals individually after the shell has been fired. It is, of course, absolutely necessary, in this regard, to provide means for setting or adjusting the transmitting part angularly relative to the receiving part so that the different transmitter windings come to lie in a correct position opposite the associated receiving windings. As required or desired, the heretofore known device permits the re-input of the information transmitted to the fuse, for checking and possible changes. The data transmitted to the fuse involve, for example, the set or nominal time to triggering, the time delay between the detection of a given event and the actual triggering of the fuse, the range to the target at which the triggering is to take place, the response threshold of sensors, and the instant and method of analysis for scatter ammunition, and so forth.

The application of the heretofore known device produces almost insoluble difficulties in practice. Thus, it is very difficult to ensure the correct mutual position of the transmitting and receiving coils. Another difficulty arises from the fact that the transmitting coils must be arranged at the exit end of the gun or mortar barrel, since relative motion between the transmitting and receiving coils is necessary for the operation, the transmitting coils being subjected to high pressures and temperatures as well as, possibly, to enemy fire.

From German Published Prosecuted Application (DE-AS) No. 29 20 853, a transport case with a multiplicity of chambers is known, each of which serves to receive a projectile which has an electrically adjustable fuse. In every chamber, a fuse-setting cap is provided, which is fastened to the respective fuse. Electrical signals are delivered to the fuse via the fuse-setting cap, for setting the fuse before it is removed from the chamber. A network connects every setting cap to input circuits which receive coded signals from a source, for example, a fire control computer.

In this heretofore known construction, the electronic fuses are set wire-bound and contact-bound, special ammunition cases having to be used. It is very cumberson and, in rough operation, also prone to malfunctioning. Furthermore, it is expensive because all transport boxes used heretofore must be exchanged for new ones.

U.S. Pat. No. 3,670,652 shows an electronic fuse having a firing characteristic which can be set by radio. The fuse contains its own power supply. A microwave transmitter serves for remote transmission of the data. The antenna at the projectile fuse is designed as a slot antenna.

U.S. Pat. No. 3,844,217 discloses an electronic fuse having a time base which is set mechanically prior to the start. During flight, the set data can be changed by means of a radar transmitter. An inertial generator and/or a battery serves as the power supply of the fuse. The two last-mentioned U.S. patents also disclose electric circuit details of the data signal receiver, the data processing unit and the fuse electronic system proper. In both cases, however, the possibility of monitoring or controlling the proper operation as well as the correct transmission of the fuse-setting values is lacking.

It has also been known heretofore to program shell fuses by mechanically rotating rings provided at the outside of the fuse. The amount of information that can be transmitted is very limited, however, and only visual checking is possible, and relatively great amount of time is consumed due to the mechanical programming.

It is therefore an object of the invention to provide an apparatus for setting and/or monitoring the operation of an electronic fuse for shells which affords the establishment of an information connection with the shell fuse permitting reliable data transmission, and allowing checking of the data of the shell fuse, whereby, if required or desired, a fault diagnosis can be performed which can be repeated at any time. A further object of the invention is to provide apparatus as requires only little space and weight, operates without an electric power supply of its own and is rapid and inexpensive.

With the foregoing and other objects in view, there is provided in accordance with the invention, an apparatus for setting and/or monitoring the operation of an electronic fuse for shells to be fired from a gun, by transmitting a microwave data signal and a microwave energy signal to a device inside the fuse from a device outside the fuse, the device inside the fuse including an energy receiver with a rectifier for generating a supply voltage, a data receiver, a data processing unit and a fuse electronic system, and the device outside the fuse including an energy transmitter, and input/output unit and a data transmitter, comprising means for disposing the device outside the fuse so that the transmission of the microwave signals occurs at the latest during loading of the shell carrying the fuse into the gun; means for transmitting the energy signal and the data signal together and simultaneously; a reply signal transmitter additionally included in the device inside the fuse; a reply signal receiver additionally included in the device outside the fuse; the data-signal transmitting means and the reply signal transmitter being actuable for transmitting and exchanging information in opposite directions; and a respective single antenna located at the fuse and at the device outside the fuse for receiving and transmitting energy, data and reply signals.

The term "gun" is understood, within the scope of this application, to mean both barrel or rifle weapons as well as mortar devices. By the term "shell", there is meant any kind of ammunition which is capable of carrying an electronic data processing device and fuse electronic system as well as an antenna.

Advantages deriving therefrom are that the gun barrel need not be altered; that the data transmission in both directions can take practically as long as desired since the energy signal, the data signal and, if applicable, the reply signal are transmitted simultaneously; that no energy accumulator for the supply voltage is required in the fuse electronics or electronics system so that safety is assured when firing a shell; that no changes whatsoever are required in the shell, the gun, the transport boxes and so forth; that an exchange of information from the fire control computer, which is simultaneously utilized for controlling the fuse operation, to the fuse and vice versa is possible; and that this information exchange can occur at any time and as often as desired; and that control of the operation of the fuse between the time of its manufacture and the time of its use, for example, while it is in the ammunition depot, is possible at any time.

The invention makes use of the devices described in German Published Prosecuted Application (DE-AS) No. 25 08 201 and (DE-AS) No. 29 19 753, particularly. They relate to installations formed of a stationary interrogator and a movable transponder. The interrogator has an energy transmitter and an opening-code transmitter emitting an opening code which is stored in an opening-code memory and, optionally, in a supplementary opening-code memory, as well as an identification receiver and a data processing unit. The transponder contains an energy receiver which converts the radiated energy into the power supply for the electronics of the transponder. The transponder further contains an opening code receiver followed by an opening code comparator which compares the code stored in an opening code memory and, optionally, in a supplementary opening code memory, with the code received by ratio. The output signal of the opening code comparator controls, via an opening-code processor, and identification transmitter. The identification, which can be emitted by a further radio channel to the interrogator, is stored in an identification memory and, optionally, in one or more supplementary identification memories. By means of an additional identification coding receiver in the transponder, the identity part stored in the supplementary identity memory can be changed via radio as desired. Because the incident energy is naturally small, and yet the identity transmitter ought to radiate a reply signal which is as powerful as possible to achieve a long range, the signal carrier to be emmitted by the identity transmitter can be generated in the stationary interrogator and transmitted with the energy beam and the opening code to the movable transponder, wherein the reply signal carrier is merely modulated by the identity transmitter before it is reradiated.

In applying the invention, all ammunition is equipped with a respective transponder to the extent that it is sensible. Since the transponder is primarily formed of a transmitting and receiving antenna, a rectifier circuit, a code memory and comparator circuit, a fuse electronic circuit and an acknowledgment device, which is realized as an integrated semiconductor circuit, and a battery is not required for voltage supply, the physical or spatial dimensions of the transponder can be kept very small through a suitable choice of the transmitting and receiving frequencies.

In accordance with another feature of the invention, the apparatus comprises circuit means for checking and acknowledging preprogrammed and set-in fuse data as well as proper operation of a fuse electronic system, after transmitting a data signal. The checking and acknowledgment can, in fact, be effected not only when the gun is being loaded but at any time. In this manner, defective fuses can be discarded even prior to the firing.

In accordance with a further feature of the invention, the antenna at the fuse is circularly polarized. Accordingly, the normally existing positional dependence of the data transmission due to linear polarization of both antennas can be prevented reliably. While it would be possible to mount several linearly polarized antennas on the fuse, the need thereby arises of going to extremely high frequencies because the space at the tip of the fuse and on the outside of the fuse, respectively, is generally limited. While small antenna dimensions can be achieved when going to extremely high frequencies in the gigahertz range, the energy flow is nevertheless limited by the effective antenna surface area. Small antenna surfaces result in a small energy flow. This, however, is contradictory to the requirement to transmit as much power as possible in order to supply the device inside the fuse with an adequate supply voltage. It has therefore been found to be an advantageous feature of the invention to provide the antenna at the fuse with circular polarization.

In accordance with an additional feature of the invention, the antenna is constructed as a dielectric rod radiator.

In accordance with an added feature of the invention, the fuse has a flat forward end, and the antenna is fastened thereto. This arrangement makes it easier for the operating personnel to ensure the mutual orientation of the antennas which is necessary for proper energy and data transmission; the tip of the shell must be held in a simple manner in the direction toward the setting equipment standing next to the gun.

In accordance with yet another feature of the invention, the device within the fuse is an electronic device, and including a connecting line between the antenna at the fuse and the electronic device within the fuse, the connecting line being destroyed at high accelerations, i.e. when the shell is fired. Thus, the shell is fired, the fuse setting data is thereby prevented from being changed by electronic countermeasures of the enemy.

In accordance with yet a further feature of the invention, the device inside the fuse includes an identification memory which is loaded with an individual identification number when the fuse setting data are being transmitted. While it has been customary heretofore to provide electronic transponders, such as radar transponders and the like, with an individual identification address beforehand at the factory so that they can be addressed later at any time individually, this is not necessarily provided in the invention of the instant application. Rather, all fuses are preferably "nameless" when they leave the factory. In programming the fuse, a running number is assigned as an individual address, so that every fuse can then be addressed, programmed, checked and fired individually. Because customarily, a programmed fuse is fired within a relatively short time, the number of digits required for the identity memory is very small whereas, according to the conventional method, the number of digits would have to be kept very large, since the number of fuses produced is naturally very great. If, for practical reasons, a previously named and programmed fuse is not fired, it is entirely possible to rename and reprogram it, respectively.

In accordance with yet an additional feature of the invention, the device inside the fuse includes filter means for filtering the data signal continuously out of the received signal mixture of the energy signal and the data signal.

In accordance with a concomitant feature of the invention which improves the safety and reliability in front of the muzzle and during fly-over, only the data receiver, the data processing unit and the reply signal transmitter but not the firing circuit itself are supplied with a supply voltage obtained from the energy signal. This is a measure not always fulfilled in the state of the art described in the introduction hereto.

It is believed to be needless to emphasize that the data exchange between the interrogator and the transponder of the apparatus according to the invention for the automatic identification of objects and/or living beings must be secured by suitable measures against localization and repreogramming by the enemy. In this respect, the opening code memories and comparators provided in the apparatus for the automatic identification of objects and/or living beings as well as the freely programmable supplemental memories serve very well.

Other features which are considered as characteristic for the invention are set forth in the appended claims.

Although the invention is illustrated and described herein as embodied in an apparatus for setting and/or monitoring the operation of a shell fuse or detonator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
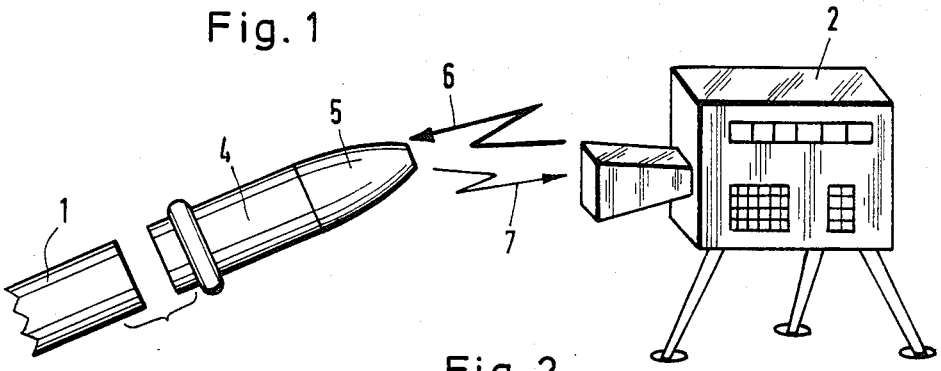
FIG. 1 is a diagrammatic view of a fuse and fuse programming equipment according to the invention.

Referring now to the drawing and first, particularly, to FIG. 1, there is shown therein the physical or spatial relationship of a fuse 5 to fuse programming equipment 2. The equipment 2 contains primarily an input/output unit, an energy transmitter, a data transmitter, a reply signal receiver as well as a data processing unit. The wireless information connection from the equipment 2 to the fuse 5, which is screwed onto a shell 4 and is to be loaded therewith into a gun 1, is established via a first radio channel 6. The reply signals from the fuse 5 to the programming equipment 2 are acknowledged via a second radio channel 7.

Figure 2:
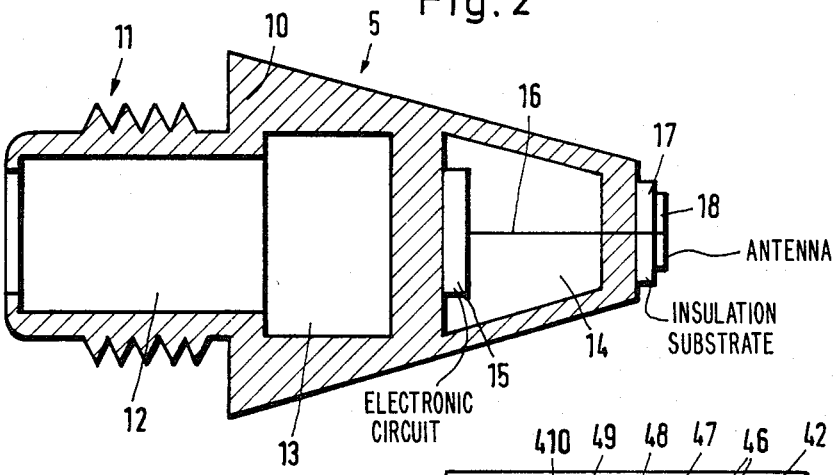
FIG. 2 is a longitudinal sectional view of a shell fuse.

FIG. 2 is a longitudinal sectional view of the fuse. There is shown therein a metal part 10 conically tapered toward the front thereof and having a thread 11 at the rear end thereof, by which the fuse 5 can be screwed to the shell 4. In the interior of the fuse 5 are various cavities 12, 13 and 14 which serve to accommodate, among other things, conventional fuse components such as a powder charge, a safety device, a battery, an inertia generator and so forth and, at a suitable location, an electronic circuit 15, for example, in the form of an integrated semiconductor circuit which is wired as a signal receiver, a data receiver, a data processing unit, a fuse electronic system, an identification memory and a reply signal transmitter. From the electronic circuit 15, an antenna line 16 leads to an antenna 18 mounted on the flat front end of the fuse 5. This antenna 18 is a microwave antenna which is attached by a strip line technique to an insulation substrate 17 or is formed as a dielectric rod radiator.

In the embodiment according to FIG. 2, the antenna 18 is constructed as a circularly polarized antenna so as to ensure a trouble-free radio connection without minima of the receiving field strength, independently of the rotational orientation of the fuse relative to the programming equipment 2.

By suitable construction of the antenna line 16, it can be caused to break when the shell is fired, so that proper operation, especially of the fuse electronic system, cannot be influenced by electronic measures of the enemy.

Figure 3:
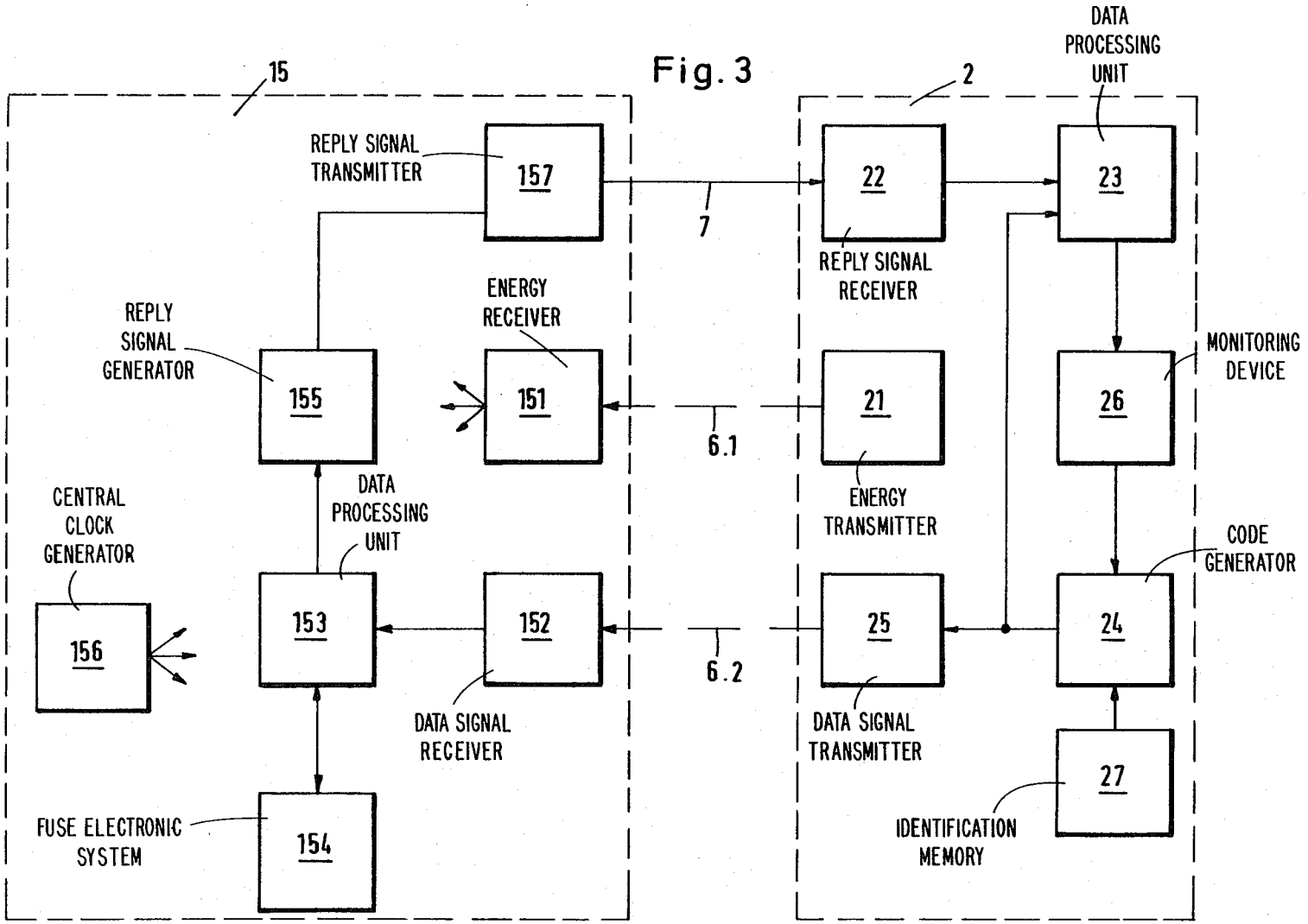
FIG. 3 is a block diagram of a device outside a device inside the fuse.

FIG. 3 shows, in the form of a block diagram the internal construction of the programming equipment 2 as well as of the electronic circuit 15 in the fuse 5. The programming equipment 2 includes energy transmitter 21 which emits an energy beam 6.1. Further contained in the programming equipment or interrogator 2 is a data signal transmitter 25 which is modulated by a data signal generator 24. The data signal generator 24 receives its information, among other things, from an identification memory 27 as well as from a monitoring device 26. In addition, the data signal generator 24 transmits its information to a data processing unit 23. The data processing unit 23 further receives information from a reply signal receiver 22 which receives reply signals from the fuse circuit 15 via a radio channel 7. The signals received by the reply signal receiver 22 are evaluated in the data processing unit 23, are compared with the data stemming from the code generator 24 and displayed if necessary or desirable. If the data processing unit 23 detects an error, this is evaluated in the monitoring device 26 and, for example, a repetition of the programming process is initiated.

In the electronic circuit 15 inside the fuse, there is primarily an energy receiver 151 which converts the energy radiated by the energy transmitter 21 into a supply voltage for the remaining modules. The data signal transmitted via a radio channel 6.2 is received by a data signal receiver 152, is demodulated and fed to a data processing unit 153. Depending upon which signal was received, the latter causes the setting or adjusting of the fuse electronic system 154, the checking of the operability and the retransmission of the data which is determined. This purpose is served by a reply signal generator 155 which modulates a reply signal transmitter 157 accordingly. A central clock generator 156 obtains, from the signals received by the data signal receiver 152, the clock frequency for all data processing operations and distributes it to the individual modules.

In a practical application, the radio channels 6.1, 6.2 and 7, shown separately in FIG. 3 of the drawing for easier understanding can be radiated and received, respectively, by only one respective antenna in the programming equipment 2 and at the fuse 5, respectively. By transmitting information in both directions it is possible to check the high-frequency transmission, to retransmit and check the programmed-in data and to check the proper operation of the fuse logic system (for example, the timer).

Figure 4:
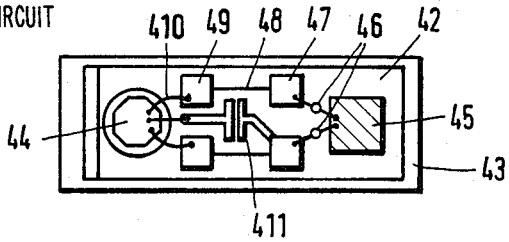
FIG. 4 is a top plan view of equipment embodying a microwave receiving and transmitting circuit.

FIG. 4 shows an embodiment of a receiving circuit for the energy signal and the data signal in the microwave range. A support plate 42 of a dielectric suitable for high frequency, for example, of aluminum oxide, polytetrafluoroethylene or the like with a rearside metallization 43 over the entire surface is shown. The rearside metalization 43 may be formed, for example, by the flat forward end of the fuse itself. On the dielectric plate 42, there is a receiving antenna 45 in the form of a square-shaped metal surface. From the antenna 45, two diodes 46 are connected to other metal surfaces 47. The metal surfaces 47 are connected via conductor leads 48 to additional metal surfaces 49, from which connecting leads 410 extend to a semiconductor circuit 44.

The respective two metal surfaces 47 and 49 as well as the connecting conductor run 48 form a CLC circuit which acts as a filter circuit and filters and smoothes the microwave energy received by the receiving antenna 45 and rectified in the diodes 46, so that it is suited as the supply voltage for the semiconductor circuit 44.

Further seen in FIG. 4 is a coupling arrangement 411 in the form of an L-C series circuit. By means of this coupling arrangement 411, modulation energy transmitted by the microwaves and received by the receiving antenna 45 is coupled out at the output of the diodes 46 and fed as a data signal directly to the semiconductor circuit 44.

While, in FIG. 4, the receiving antenna, the rectifier circuit and the semiconductor circuit are arranged on a single carrier substrate, the antenna, which used in a fuse, is advantageously arranged at the tip of the fuse, while the remaining components are arranged protected in the interior of the fuse. As already described herein, the connection is made via the antenna lead.

Figure 5:
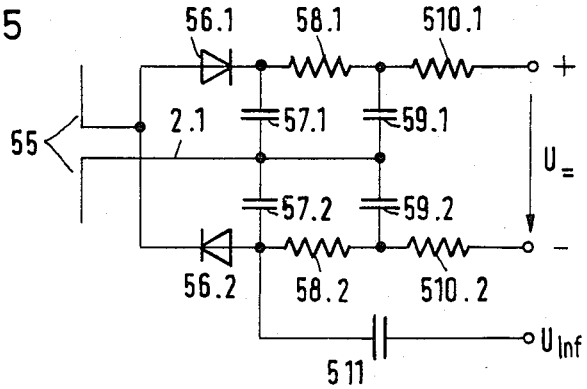
FIG. 5 is an electrical circuit diagram of the receiving circuit of FIG. 4.

FIG. 5 shows the electrical circuit diagram of the receiving circuit shown in FIG. 4. One of the two leads of the receiving antenna 55 acts as the electrical center, and the two diodes 56.1 and 56.2 are connected to the other of the two leads in a voltage doubler circuit. At the output of the two diodes 56.1 and 56.2, charging capacitors 57.1 and 57.2 are connected against the electrical center, while the electric current flows via filter chokes 58.1 and 58.2 and additional filter chokes 510.1 and 510.2 to the voltage supply terminals of the semiconductor circuit. This generates a supply voltage $U_{=}$. To the output of the diode 56.2, there is further coupled the coupling arrangement 511, which couples, from the signal mixture present at the filter capacitor 57.2, the modulation received with the microwaves, and feeds it as the data signal $u_{inf}$ to the semiconductor circuit 44.

We claim:

1. Apparatus for performing at least one of the functions of setting and monitoring the operation of an electronic fuse for shells to be fired from a gun, by transmitting a microwave data signal and a microwave energy signal to a device inside the fuse from a device outside the fuse, the device inside the fuse including an energy receiver with a rectifier for generating a supply voltage, a data receiver, a data processing unit and a fuse electronic system, and the device outside the fuse including an energy transmitter, an input/output unit and a data transmitter, comprising means for disposing the device outside the fuse so that the transmission of the microwave signals occurs at the latest during loading of the shell carrying the fuse into the gun; means for transmitting the energy signal and the data signal together and simultaneously; a reply signal transmitter additionally included in the device inside the fuse; a reply signal receiver additionally included in the device outside the fuse; said data-signal transmitting means and said reply signal transmitter being actuable for transmitting and exchanging information in opposite directions; and a respective single antenna located at the fuse and at the device outside the fuse for receiving and transmitting energy, data and reply signals.

2. Apparatus according to claim 1 comprising circuit means for checking and acknowledging preprogrammed and set-in fuse data as well as proper operation of a fuse electronic system, after transmitting a data signal.

3. Apparatus according to claim 1 wherein the antenna at the fuse is circularly polarized.

4. Apparatus according to claim 1 wherein the antenna is constructed as a dielectric rod radiator.

5. Apparatus according to claim 1 wherein the fuse has a flat forward end, and the antenna is fastened thereto.

6. Apparatus according to claim 5 wherein said device within the fuse is an electronic device, and including a connecting line between the antenna at the fuse and said electronic device within the fuse, said connecting line being destroyed at high accelerations.

7. Apparatus according to claim 1 wherein the device inside the fuse includes an identification memory which is loaded with an individual identification when the fuse setting data are being transmitted.

8. Apparatus according to claim 1 wherein the device inside the fuse includes filter means for filtering the data signal continuously out of the received signal mixture of the energy signal and the data signal.

9. Apparatus according to claim 1 wherein only the data receiver, the data processing unit and the reply signal transmitter are supplied with a supply voltage obtained from the energy signal.

* * * * *